US011233334B2

(12) United States Patent
Ko et al.

(10) Patent No.: US 11,233,334 B2
(45) Date of Patent: Jan. 25, 2022

(54) PHASE COMPENSATION LENS ANTENNA DEVICE

(71) Applicant: Samsung Electronics Co., Ltd., Suwon-si (KR)

(72) Inventors: Seungtae Ko, Suwon-si (KR); Yoongeon Kim, Suwon-si (KR); Sangho Lim, Suwon-si (KR); Seungku Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 50 days.

(21) Appl. No.: 16/487,313

(22) PCT Filed: Feb. 21, 2018

(86) PCT No.: PCT/KR2018/002144
§ 371 (c)(1),
(2) Date: Aug. 20, 2019

(87) PCT Pub. No.: WO2018/155909
PCT Pub. Date: Aug. 30, 2018

(65) Prior Publication Data

US 2020/0021034 A1 Jan. 16, 2020

(30) Foreign Application Priority Data

Feb. 21, 2017 (KR) ..... 10-2017-0022978

(51) Int. Cl.
*H01Q 15/08* (2006.01)
*H01Q 15/23* (2006.01)
*H01Q 19/06* (2006.01)

(52) U.S. Cl.
CPC ..... *H01Q 15/08* (2013.01); *H01Q 15/23* (2013.01); *H01Q 19/06* (2013.01)

(58) Field of Classification Search
CPC ..... H01Q 15/08; H01Q 15/23; H01Q 19/06; H01Q 21/061; H01Q 19/062
(Continued)

(56) References Cited

U.S. PATENT DOCUMENTS 4,503,382 A * 3/1985 Zehl ..... G01R 23/17 324/76.37
5,982,326 A * 11/1999 Chow ..... H01Q 9/0435 342/365

(Continued)

FOREIGN PATENT DOCUMENTS

CN 102800976 A 11/2012
CN 103036066 A 4/2013

(Continued)

OTHER PUBLICATIONS

Tao Zui et al., "A Millimeter-Wave System of Antenna Array and Metamaterial Lens", IEEE Antennas and Wireless Propagation Letters, vol. 15 , pp. 370-373, XP011600867, ISSN: 1536-1225, DOI: 10.1109/LAWP.2015.2446500 [retrieved on Feb. 25, 2016].

(Continued)

*Primary Examiner* — Don P Le
(74) *Attorney, Agent, or Firm* — Jefferson IP Law, LLP

(57) ABSTRACT

A phase compensation lens antenna comprises: an antenna array comprising a plurality of antennas; and a planar lens disposed parallel to the antenna array, wherein the planar lens has unit cells disposed in a straight line pattern or an open curve pattern, and the unit cells can correct the phase of a radio wave radiated from the antenna array, based on the permittivity.

15 Claims, 19 Drawing Sheets

(58) Field of Classification Search
USPC ..... 343/911 R
See application file for complete search history.

(56) References Cited

U.S. PATENT DOCUMENTS

| | | | | |
|---|---|---|---|---|
| 2002/0067317 | A1 | 6/2002 | Sakurada | |
| 2006/0097916 | A1* | 5/2006 | Bogosanovic | H01Q 3/30 343/700 MS |
| 2009/0160718 | A1* | 6/2009 | Yen | H01Q 15/10 343/742 |
| 2011/0199273 | A1 | 8/2011 | Kim et al. | |
| 2013/0002500 | A1 | 1/2013 | Liu et al. | |
| 2013/0333207 | A1 | 12/2013 | Lee et al. | |
| 2014/0009350 | A1 | 1/2014 | Lam et al. | |
| 2014/0035783 | A1* | 2/2014 | Contarino | G01S 19/215 342/357.59 |
| 2015/0091767 | A1* | 4/2015 | Matitsine | H01Q 1/42 343/755 |
| 2015/0116154 | A1 | 4/2015 | Artemenko et al. | |
| 2015/0200452 | A1* | 7/2015 | Oh | H01Q 19/062 343/754 |
| 2016/0240923 | A1 | 8/2016 | Oh et al. | |
| 2017/0279201 | A1* | 9/2017 | Gerding | H01Q 15/08 |
| 2019/0058257 | A1* | 2/2019 | Song | H01Q 15/12 |
| 2019/0319363 | A1* | 10/2019 | Ko | H04B 7/0617 |
| 2019/0319365 | A1* | 10/2019 | Kim | H01Q 9/0407 |
| 2020/0018874 | A1* | 1/2020 | Chisum | H01Q 15/02 |
| 2020/0021034 | A1* | 1/2020 | Ko | H01Q 19/06 |
| 2020/0350680 | A1* | 11/2020 | Yang | H01Q 3/245 |

FOREIGN PATENT DOCUMENTS

| | | | |
|---|---|---|---|
| EP | 2 728 669 | A1 | 5/2014 |
| JP | 2002-171119 | A | 6/2002 |
| KR | 10-2002-0015428 | A | 2/2002 |
| KR | 10-2002-0031300 | A | 5/2002 |
| KR | 10-2010-0083759 | A | 7/2010 |
| KR | 10-1332082 | B1 | 11/2013 |

OTHER PUBLICATIONS

European Search Report dated Jan. 2, 2020, issued in European Patent Application No. 18757480.1.

Eduardo B. Lima et al., "Circular Polarization Wide-Angle Beam Steering at Ka-Band by In-Plane Translation of a Plate Lens Antenna", IEEE Transactions on antennas and propagation, vol. 63, No. 12, pp. 5443-5455, Dec. 2015.

John Brady, "Beamspace MIMO for Millimeter-Wave Communications: System Architecture, Modeling, Analysis, and Measurements", IEEE Transactions on antennas and propagation, vol. 61, No. 7, pp. 3814-3827, Jul. 2013.

Yan Yang et al, 'Beam-scanning antennas based on metamaterial planar lens antennas', May 31, 2011.

Chinese Office Action dated Aug. 25, 2020, issued in Chinese Patent Application No. 201880012764.9.

Extended European Search Report dated Apr. 29, 2020, issued in European Patent Application No. 18757480.1.

Kai et al.; Terahertz Spectroscopy and Imaging; Jun. 30, 2016; p. 50-55.

Chinese Office Action with English translation dated May 24, 2021; Chinese Appln. No. 201880012764.9.

* cited by examiner

〈1301〉

〈1302〉

〈1303〉

PHASE COMPENSATION LENS ANTENNA DEVICE

TECHNICAL FIELD

Various embodiments of the present invention relate to a phase compensation lens antenna device that increases a gain and coverage of radio waves radiated from an antenna device.

BACKGROUND ART

In order to satisfy increases in demand for wireless data traffic now that a 4G communication system is commercially available, efforts are being made to develop an enhanced 5G communication system or a pre-5G communication system.

In order to achieve a high data transmission rate, consideration is being given to implementing the 5G communication system in a mmWave band (e.g., 60 GHz band). In order to mitigate any route loss of radio waves in a mmWave band and to increase transmission distances of radio waves, the technologies of beamforming, massive multiple input and output (MIMO), full dimensional MIMO (FD-MIMO), array antenna, analog beamforming, and large scale antenna have been discussed for the 5G communication system.

DISCLOSURE OF INVENTION

Technical Problem

In a 5G communication system, because an mmWave band is used as a radio wave band, radiation coverage of radio waves is limited because a characteristic of an mmWave band is it having strong directivity. In order to overcome the limited radiation coverage, even though an array antenna is used, there is a limitation in a gain of radio waves that may be transmitted.

The present invention provides a phase compensation lens antenna device that can provide wide coverage and a high gain for transmission and reception of radio waves.

Solution to Problem

In accordance with an aspect of the present invention, an electronic device, for example, a phase compensation lens antenna, includes an antenna array including a plurality of antennas and a planar lens disposed parallel to the antenna array, wherein unit cells of the planar lens are disposed in a linear pattern or an open curve pattern, and wherein the unit cells are configured to compensate a phase of radio waves radiated from the antenna array according to permittivity.

Advantageous Effects of Invention

A phase compensation lens antenna device according to various embodiments of the present invention can provide wide coverage and a high gain for transmission and reception of radio waves.

MODE FOR THE INVENTION

Figure 1:
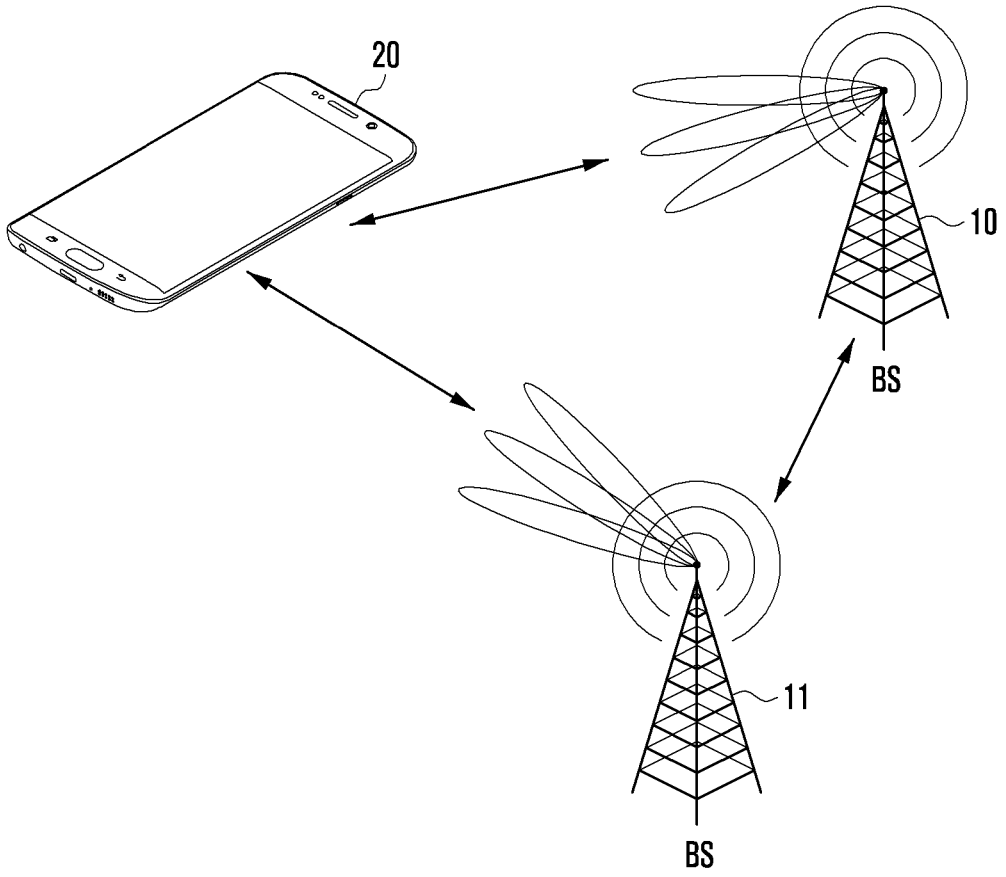
FIG. 1 is a diagram illustrating a network between a base station and an electronic device according to an embodiment of the present invention.

Hereinafter, various embodiments of this document will be described in detail with reference to the accompanying drawings. It should be understood that embodiments and terms used in the embodiments do not limit technology described in this document to a specific embodiment and include various changes, equivalents, and/or replacements of a corresponding embodiment. The same reference numbers are used throughout the drawings to refer to the same or like parts. Unless the context otherwise clearly indicates, words used in the singular include the plural, and the plural includes the singular. In this document, an expression such as "A or B" and "at least one of A or/and B" may include all possible combinations of the together listed items. An expression such as "first" and "second" used in this document may indicate corresponding constituent elements regardless of order and/or importance, and such an expression is used for distinguishing a constituent element from another constituent element and does not limit corresponding constituent elements. When it is described that a constituent element (e.g., a first constituent element) is "(functionally or communicatively) coupled to" or is "connected to" another constituent element (e.g., a second constituent element), it should be understood that the constituent element may be directly connected to the other constituent element or may be connected to the other constituent element through another constituent element (e.g., a third constituent element).

In this document, "configured to (or set to)" may be interchangeably used in hardware and software with, for example, "appropriate to", "having a capability to", "changed to", "made to", "capable of", or "designed to" according to a situation. In any situation, an expression "device configured to" may mean that the device is "capable of" being configured together with another device or component. For example, a "processor configured to (or set to) perform phrases A, B, and C" may mean an exclusive processor (e.g., an embedded processor) for performing a corresponding operation or a generic-purpose processor (e.g., CPU or application processor) that can perform a corresponding operation by executing at least one software program stored at a memory device.

An electronic device according to various embodiments of this document may include at least one of, for example, a smart phone, tablet personal computer (PC), mobile phone, video phone, electronic book reader, desktop PC, laptop PC, netbook computer, workstation, server, personal digital assistant (PDA), portable multimedia player (PMP), MP3 player, medical device, camera, and wearable device. The wearable device may include at least one of an accessory type device (e.g., watch, ring, bracelet, ankle bracelet, necklace, glasses, contact lens), head-supported-device (HMD), textile or clothing integral type device (e.g., electronic clothing), body attachment type device (e.g., skin pad or tattoo), and bio implantable circuit. In some embodiments, the electronic device may include at least one of, for example, a television, digital video disk (DVD) player, audio device, refrigerator, air-conditioner, cleaner, oven, microwave oven, washing machine, air cleaner, set-top box, home automation control panel, security control panel, media box (e.g., Samsung HomeSync™, Apple TV™, or Google TV™), game console (e.g., Xbox™, PlayStation™), electronic dictionary, electronic key, camcorder, and electronic frame.

In another embodiment, the electronic device may include at least one of various medical devices (e.g., various portable medical measurement devices (blood sugar measurement device, heartbeat measurement device, blood pressure measurement device, or body temperature measurement device), magnetic resonance angiography (MRA) device, magnetic resonance imaging (MRI) device, computed tomography (CT) device, scanning machine, and ultrasonic wave device), navigation device, global navigation satellite system (GNSS), event data recorder (EDR), flight data recorder (FDR), vehicle infotainment device, ship electronic equipment (e.g., ship navigation device, gyro compass), avionics, security device, vehicle head unit, industrial or home robot, drone, automated teller machine (ATM) of a financial institution, point of sales (POS) of a store, and Internet of things device (e.g., bulb, various sensors, sprinkler, fire alarm, thermostat, street light, toaster, exercise device, hot water tank, heater, boiler). According to some embodiments, the electronic device may include at least one of furniture, a portion of a building/structure or a vehicle, electronic board, electronic signature receiving device, projector, and various measurement devices (e.g., water supply, electricity, gas, or electric wave measurement device). In various embodiments, the electronic device may be flexible or maybe two or more combinations of the foregoing various devices. An electronic device according to an embodiment of this document is not limited to the foregoing devices. In this document, a term "user" may indicate a person using an electronic device or a device (e.g., artificial intelligence electronic device) using an electronic device.

FIG. 1 is a diagram illustrating a network between base stations 10 and 11 and an electronic device 20 according to various embodiments of the present invention.

In a 5G communication system, because an mmWave band is used as a radio wave band, coverage that can transmit and receive radio waves is limited because a characteristic of an mmWave band is it having strong directivity, but when a phase compensation lens antenna device according to an embodiment of the present invention is used, a gain and coverage may be increased.

Figure 2:
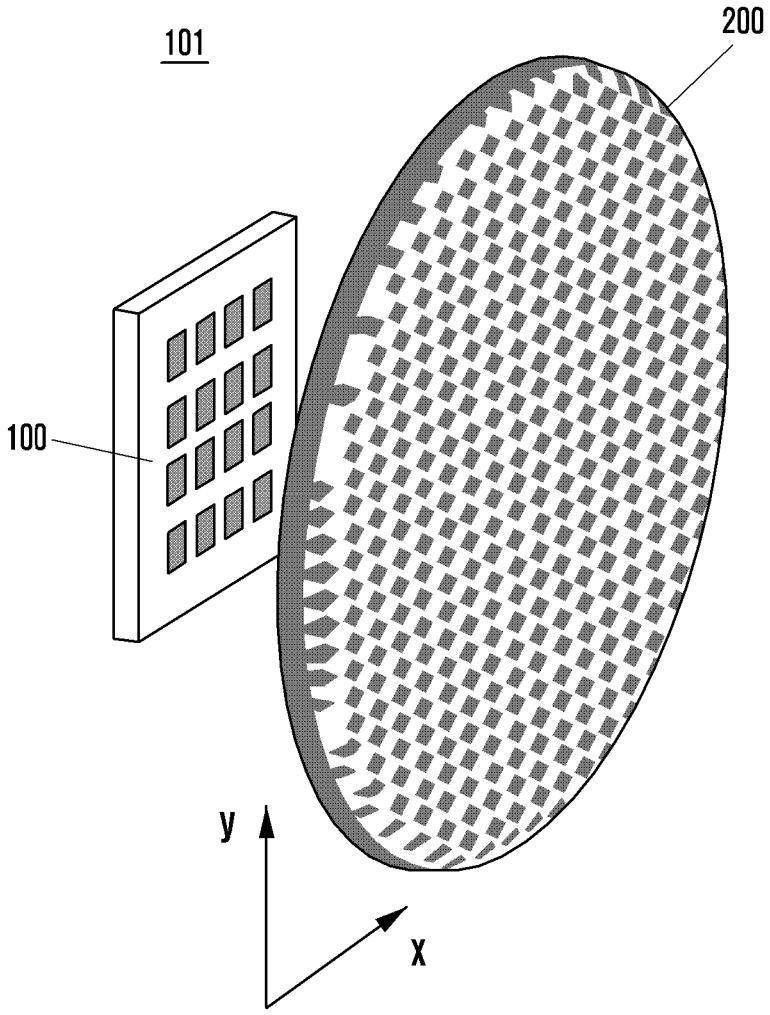
FIG. 2 is a diagram illustrating a phase compensation lens antenna device according to various embodiments of the present invention.

FIG. 2 is a diagram illustrating a phase compensation lens antenna device 101 according to various embodiments of the present invention.

A phase compensation lens antenna device 101 according to various embodiments of the present invention may include an antenna array 100 and a planar lens 200. The planar lens 200 includes a plurality of unit cells, and the unit cells may make a refractive index of a radio wave different according to an intrinsic permittivity. The planar lens 200 may refract radio waves radiated from the antenna array 100 to correct a phase thereof.

In the planar lens 200 according to various embodiments of the present invention, by disposing unit cells having the same permittivity in an x-axis direction and unit cells having different permittivity in a y-axis direction, when radio waves radiated from the antenna array 100 passes through the x-axis direction, the radio waves have the same phase as that of radio waves incident on the planar lens 200 and thus coverage of the output radio waves can be amplified.

A unit cell according to various embodiments of the present invention may have a three-dimensional shape having a unit area and height. Although the unit cells have the same unit area, permittivity between the unit cells may vary according to a material and height of the dielectric materials constituting the unit cells. For example, when the unit cells have dielectric materials of the same unit area and material, permittivity may vary according to a height between the unit cells.

When unit cells included in the planar lens 200 have the same unit area and height, the unit cells may have different permittivity according to a material of the dielectric material. In the planar lens 200 according to various embodiments of the present invention, when the unit cells having the same unit area and height are disposed in both an x-axis and a y-axis, by disposing unit cells having the same permittivity because of the dielectric material being the same material in an x-axis direction and disposing unit cells having different permittivity because of the dielectric material being of different materials in a y-axis direction, when radio waves radiated from the antenna array 100 pass through the x-axis direction, the radio waves have the same phase as that of radio waves incident on the planar lens 200 and thus coverage of the output radio waves may be amplified.

Because permittivity may vary according to a height of unit cells having the same unit area and the same dielectric material, in the planar lens 200, by disposing unit cells having the same height in an x-axis direction and disposing unit cells having different heights in a y-axis direction, when radio waves radiated from the antenna array 100 pass through the x-axis direction, the radio waves have the same phase as that of radio waves incident on the planar lens 200 and thus coverage of the output radio waves may be amplified. For example, when the unit cells constituting the planar lens 200 have the same dielectric material and the same unit area, by making heights of the unit cells different, permittivity may be different. Unit cells forming a pattern may have the same height, and unit cells of other patterns may have a height difference.

In the planar lens 200 according to various embodiments of the present invention, by forming a metal pattern on the planar lens 200 without disposing unit cells, a phase of radio waves radiated from the antenna array 100 may be changed.

In the planar lens 200 according to various embodiments of the present invention, by disposing unit cells having the same permittivity in the x-axis direction and disposing unit cells having different permittivity in the y-axis direction, when radio waves radiated from the antenna array 100 pass through the y-axis direction, all radio waves output to the planar lens 200 have the same phase and thus a gain of the output radio waves may be increased. The antenna array 100 may be a substrate having a plurality of antennas. The planar lens 200 may dispose unit cells having the same permittivity in each pattern and be configured with unit cells having various permittivity.

Figure 3:
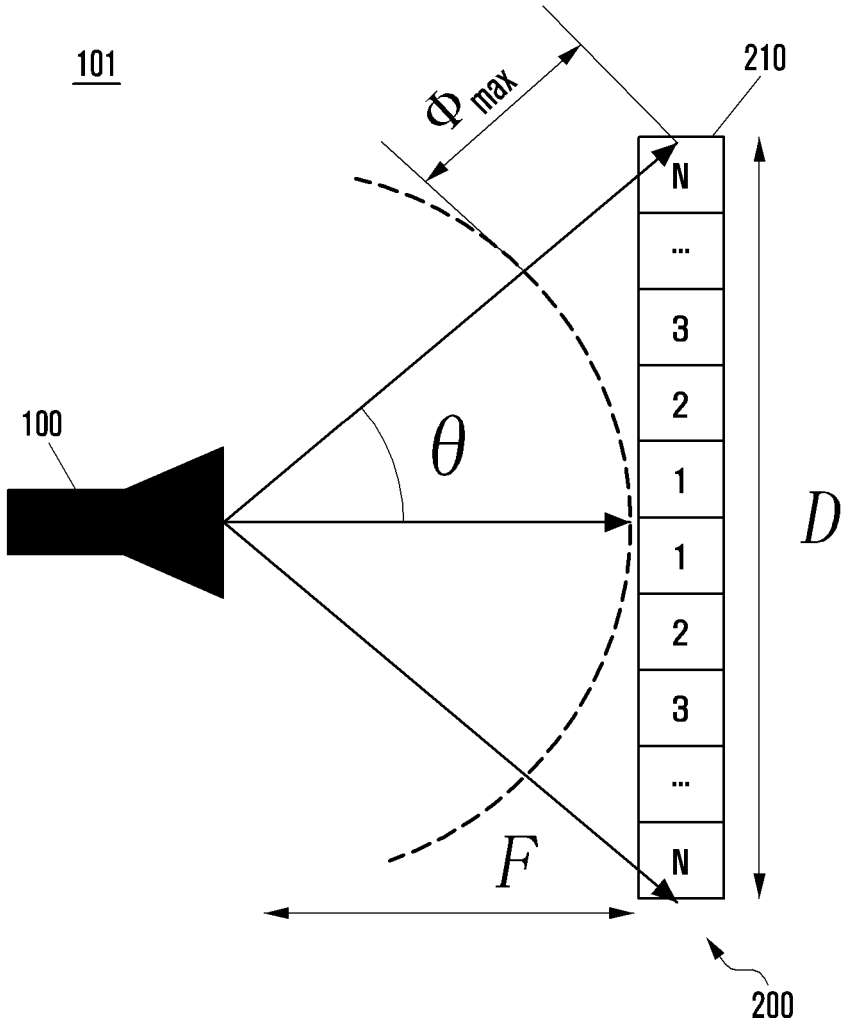
FIG. 3 is a diagram illustrating a maximum phase difference of a phase compensation lens antenna according to various embodiments of the present invention.

FIG. 3 is a diagram illustrating a maximum phase difference of a phase compensation lens antenna 101 according to various embodiments of the present invention.

A maximum phase difference before radio waves radiated from the antenna array 100 pass through the planar lens 200 is represented by Equation 1.

$$\Phi_{max} = \frac{2\pi}{\lambda}\left[\sqrt{1+\left(\frac{D}{2F}\right)^2} - 1\right] \quad \text{Equation 1}$$

A phase difference when radiated radio waves reach the planar lens 200 may be corrected according to a refractive index of a unit cell included in the planar lens 200.

Figure 4:
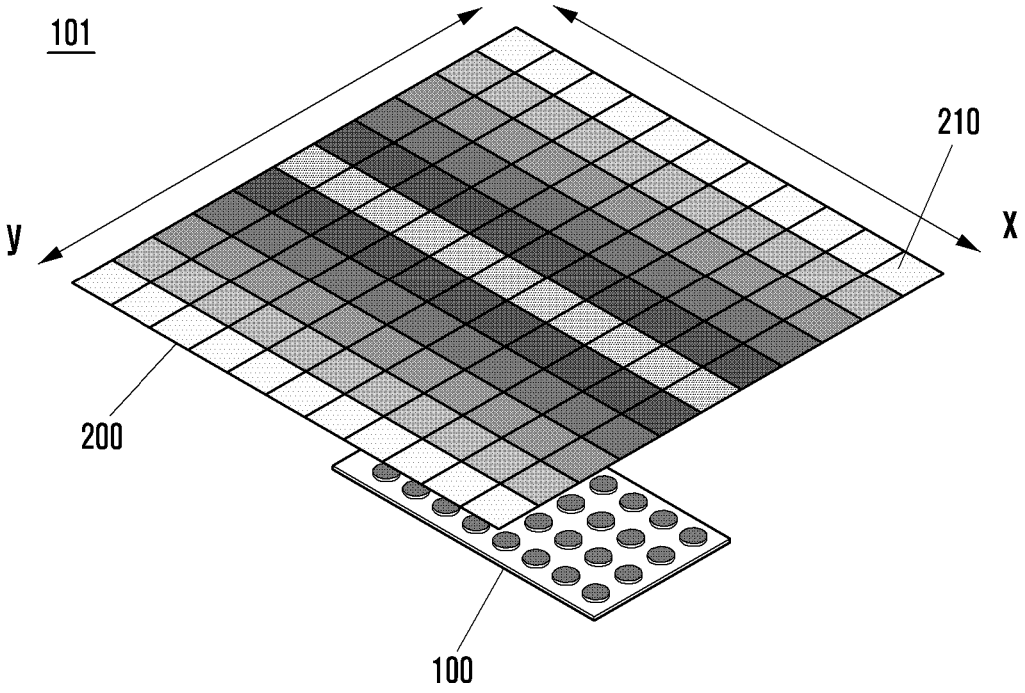
FIG. 4 is a diagram illustrating a phase compensation lens antenna according to various embodiments of the present invention.

FIG. 4 is a diagram illustrating a phase compensation lens antenna 101 according to various embodiments of the present invention.

The phase compensation lens antenna device 101 according to various embodiments of the present invention may include an antenna array 100 and a planar lens 200. The planar lens 200 may include a plurality of unit cells 210.

In the planar lens 200 according to various embodiments of the present invention, by disposing unit cells 210 having the same permittivity in an x-axis direction and disposing unit cells having different permittivity in a y-axis direction, when radio waves radiated from the antenna array 100 pass through the x-axis direction of the planar lens 200, radio waves output from the planar lens 200 and radio waves incident on the planar lens 200 have the same phase and thus coverage of the output radio waves may be amplified, and when radio waves radiated from the antenna array 100 pass through the y-axis direction of the planar lens 200, all radio waves output from the planar lens 200 have the same phase and thus a gain of the output radio waves may be increased.

In the planar lens 200 according to various embodiments of the present invention, by disposing unit cells 210 having the same permittivity in the x-axis direction and disposing the unit cells 210 having different permittivity in the y-axis direction, the unit cells 210 having the same permittivity in the x-axis direction may have a linear pattern with a straight line or an open curve.

In the planar lens 200 according to various embodiments of the present invention, by forming a metal pattern on the planar lens 200 without disposing unit cells, a phase of radio waves radiated from the antenna array 100 may be changed. A metal pattern on the planar lens 200 may have a linear pattern having a straight line or an open curve in the x-axis direction.

The unit cell 210 according to various embodiments of the present invention may have a three-dimensional shape having a unit area and height. The unit cells 210 have the same unit area, but permittivity of the unit cells may vary according to a material and height of dielectric materials constituting the unit cells. For example, when the unit cells 210 have the same unit area and material, permittivity may vary according to a height of the unit cells 210.

When the unit cells 210 included in the planar lens 200 have the same unit area and height, the unit cells 210 may have different permittivity according to a material. In the planar lens 200 according to various embodiments of the present invention, when the unit lens 210 having the same unit area and height is disposed at both an x-axis and a y-axis, by disposing unit cells 210 having the same permittivity because of dielectric materials of the same material in an x-axis direction and disposing unit cells 210 having different permittivity because of dielectric materials of different materials in an y-axis direction, when radio waves radiated from the antenna array 100 pass through the x-axis direction, the radio waves have the same phase as that of radio waves incident on the planar lens 200 and thus coverage of the output radio waves may be amplified.

When the unit cells 210 included in the planar lens 200 have the same unit area and dielectric materials of the same material, permittivity may vary according to a height of the unit cells 210. Therefore, in the planar lens 200, by disposing unit cells 210 having the same height in the x-axis direction and disposing unit cells 210 having different heights in the y-axis direction, when radio waves radiated from the antenna array 100 pass through the x-axis direction, the radio waves have the same phase as that of radio waves incident on the planar lens 200 and thus coverage of the output radio waves may be amplified. For example, when the unit cells 210 constituting the planar lens 200 have the same dielectric material and unit area, by making heights of the unit cells different, permittivity may be different. The unit cells 210 forming a pattern have the same height, and the unit cells 210 of other patterns may have a height difference.

In the planar lens 200 according to various embodiments of the present invention, by forming a metal pattern on the planar lens 200 without disposing unit cells, a phase of radio waves radiated from the antenna array 100 may be changed. A metal pattern on the planar lens 200 may have a linear pattern having a straight line or an open curve in the x-axis direction.

In the planar lens 200 according to various embodiments of the present invention, the unit cells 210 having the same permittivity and symmetry based on the center in the y-axis direction may be disposed in the x-axis direction.

Figure 5:
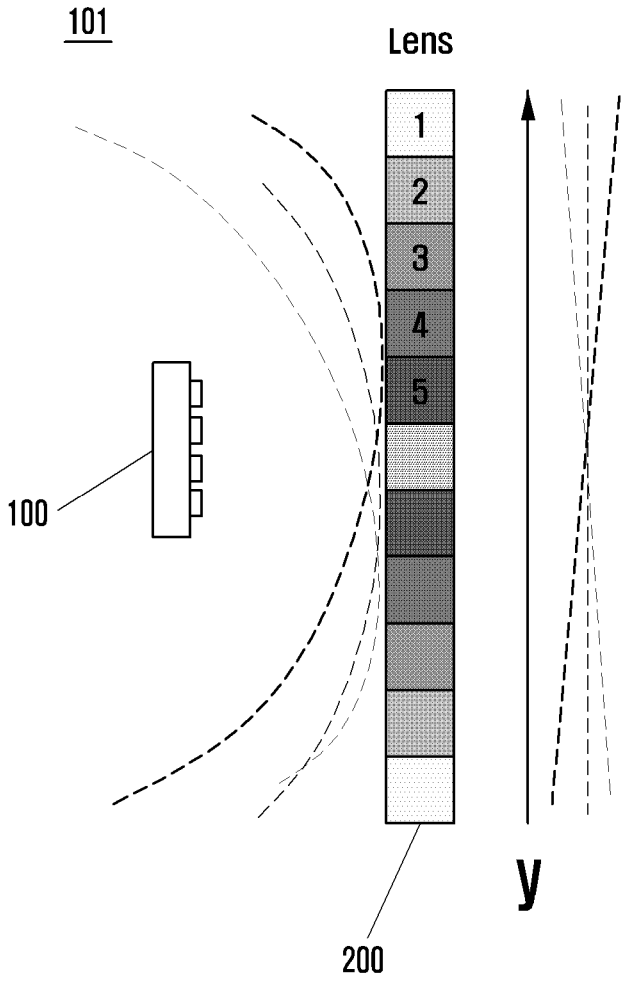
FIG. 5 is a diagram illustrating a propagation phase when a radio wave radiated from an antenna array of FIG. 4 passes through a y-axis direction of a planar lens.

FIG. 5 is a diagram illustrating a propagation phase when radio waves radiated from the antenna array 100 of FIG. 4 pass through a y-axis direction of the planar lens 200.

Figure 6:
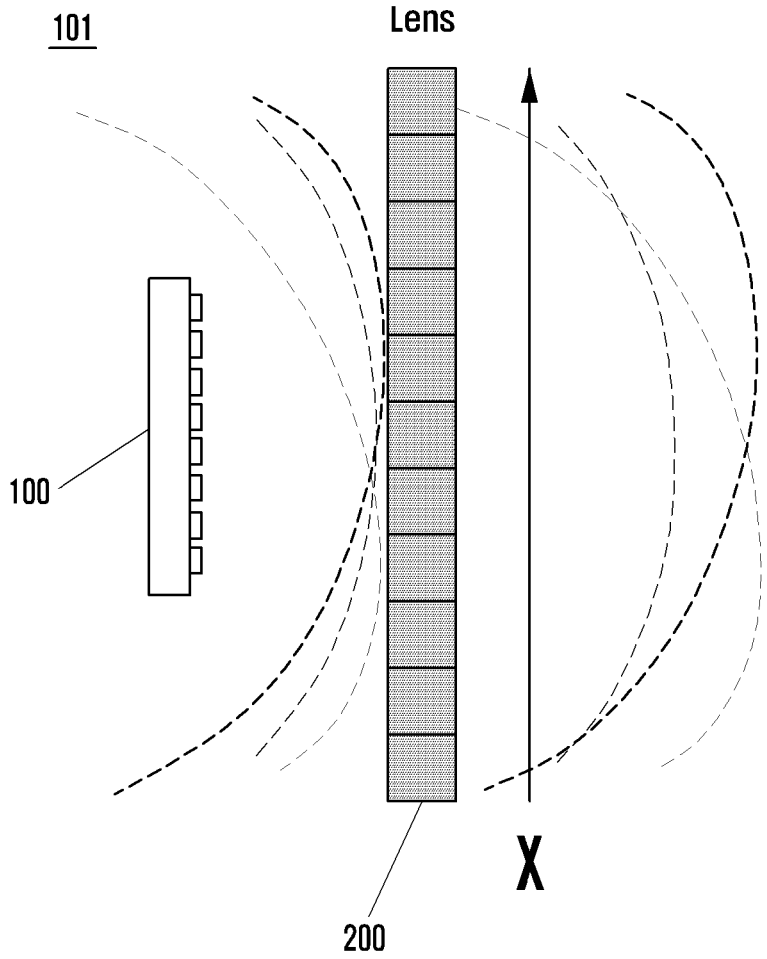
FIG. 6 is a diagram illustrating a propagation phase when a radio wave radiated from an antenna array of FIG. 4 passes through an x-axis direction of a planar lens.

FIG. 6 is a diagram illustrating a propagation phase when radio waves radiated from the antenna array 100 of FIG. 4 pass through an x-axis direction of the planar lens 200.

With reference to FIGS. 5 and 6, when radio waves radiated from the antenna array 100 pass through unit cells having different permittivity in the y-axis direction, the phase may be corrected to an in-phase. When radio waves radiated from the antenna array 100 pass through unit cells having the same permittivity in the x-axis direction, the phase may not be separately corrected.

When unit cells 210 included in the planar lens 200 have the same unit area and height, the unit cells 210 may have different permittivity according to a material of the dielectric material. In the planar lens 200, when the unit cells 210 having the same unit area and height are disposed in both the x-axis and the y-axis directions, the unit cells 210 having different permittivity because of dielectric materials of different materials may be disposed in the y-axis direction.

When the unit cells 210 included in the planar lens 200 have the same unit area and the same dielectric material, permittivity may vary according to a height of the unit cells 210. In the planar lens 200, when the unit cells 210 having the same unit area and the same dielectric material are disposed in both the x-axis and the y-axis directions, unit cells 210 having different permittivity because of different heights may be disposed in the y-axis direction.

In the planar lens 200, when the unit cells 210 having the same unit area and height are disposed in both the x-axis and the y-axis directions, the dielectric materials of the unit cells are the same and thus the unit cells 210 having the same permittivity may be disposed in the x-axis direction.

In the planar lens 200, when unit cells 210 having the same unit area and dielectric material are disposed in both the x-axis and the y-axis directions, the unit cells 210 having the same height may be disposed in the x-axis direction.

Figure 7:
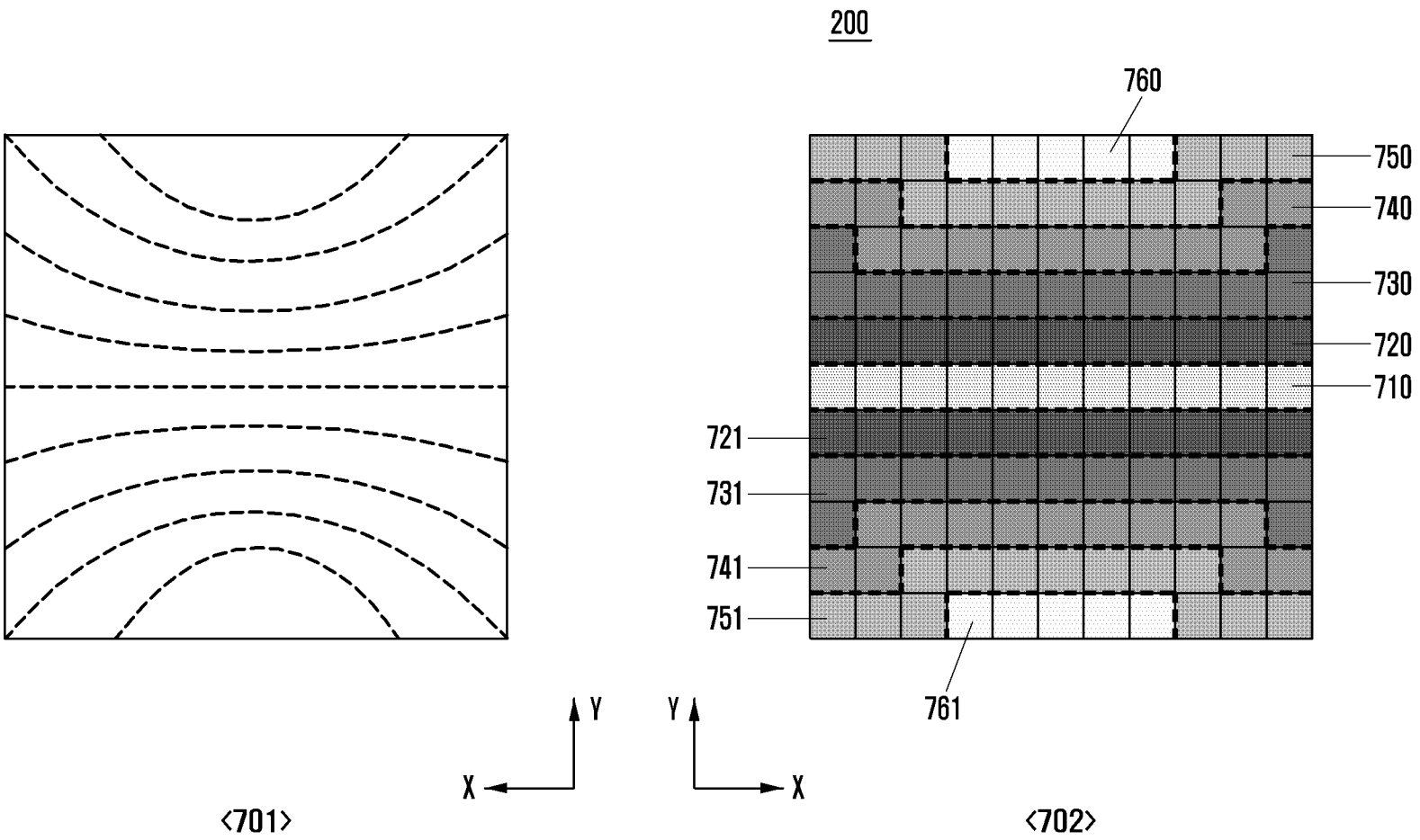
FIG. 7 is a diagram illustrating a unit cell disposition pattern on a planar lens according to various embodiments of the present invention.
Figure 8:
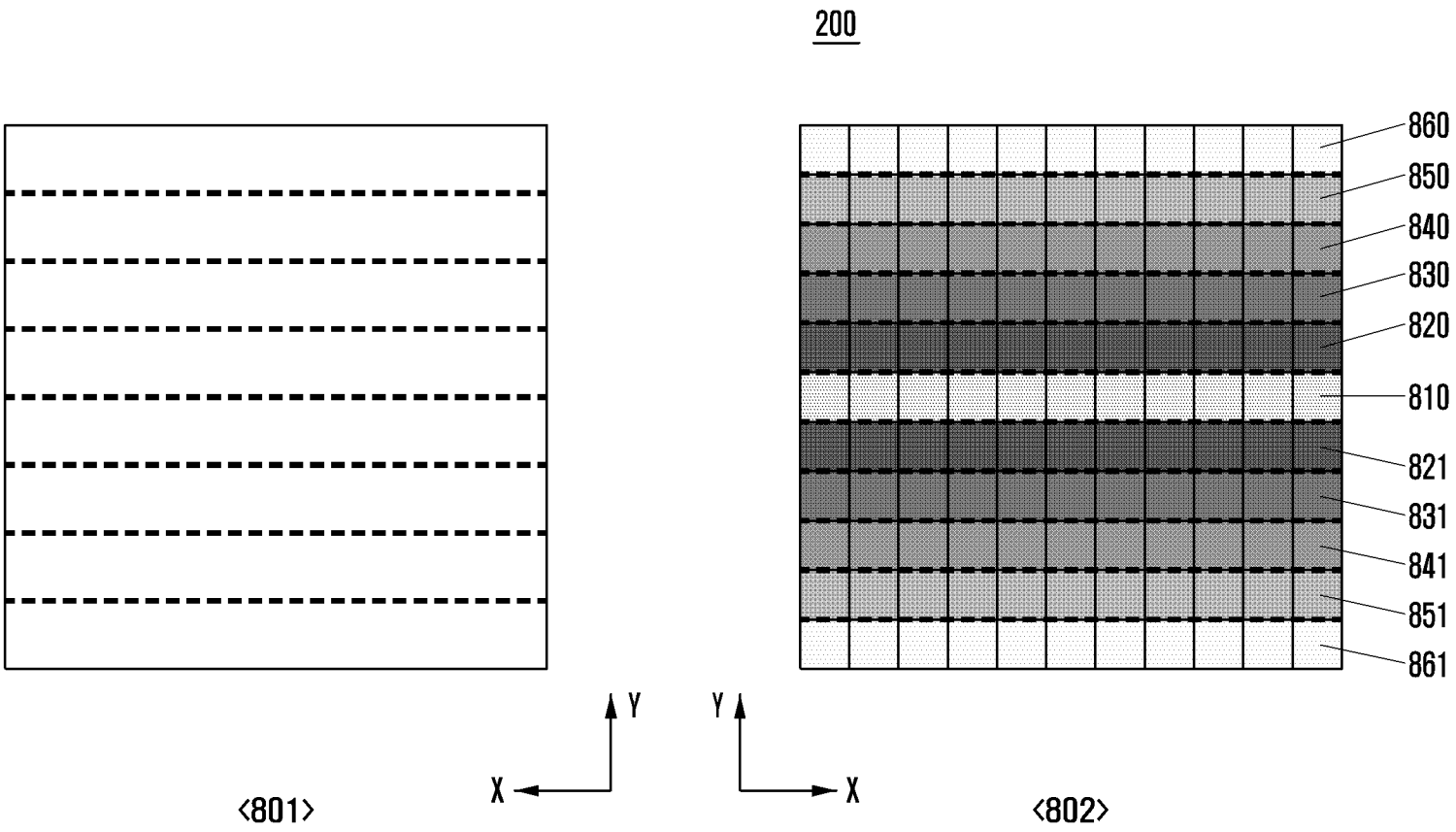
FIG. 8 is a diagram illustrating a unit cell disposition pattern on a planar lens according to various embodiments of the present invention.

FIG. 7 is a diagram illustrating a unit cell disposition pattern on a planar lens 200 according to various embodiments of the present invention. FIG. 8 is a diagram illustrating a unit cell disposition pattern on a planar lens 200 according to various embodiments of the present invention.

In reference numeral 701, unit cells disposed on the planar lens 200 may be disposed with an open curve pattern in the x-axis direction having symmetry as a reference of the center of the y-axis. A line serving as a reference of symmetry may enable unit cells to have a linear pattern in the x-axis direction. The unit cells may be disposed with a parabolic pattern in the x-axis direction and having an open curve about a linear pattern.

In reference numeral 702, unit cells disposed on the planar lens 200 may be disposed with an open curve pattern in the x-axis direction having symmetry as a reference of the center of the y-axis. A line serving as a reference of symmetry may enable unit cells to have a linear pattern 710. The unit cells may be disposed with parabolic patterns 720, 721, 730, 731, 740, 741, 750, 751, 760, and 761 in the x-axis direction about the linear pattern. The unit cells included in a symmetric pattern may have the same permittivity.

The first parabolic pattern 720 and the second parabolic pattern 721 may be symmetrical about the linear pattern 710. The unit cells in the pattern having a symmetrical relationship may have the same permittivity. The third parabolic pattern 730 and the fourth parabolic pattern 731 may be symmetrical about the linear pattern 710. The fifth parabolic pattern 740 and the sixth parabolic pattern 741 may be symmetrical about the linear pattern 710. The seventh parabolic pattern 750 and the eighth parabolic pattern 751 may be symmetrical about the linear pattern 710. The ninth parabolic pattern 760 and the tenth parabolic pattern 761 may be symmetrical about the linear pattern 710.

When unit cells on the planar lens 200 have the same unit area and height, the first parabolic pattern 720 and the second parabolic pattern 721 may be made of the same dielectric material, the third parabolic pattern 730 and the fourth parabolic pattern 731 may be made of the same dielectric material, the fifth parabolic pattern 740 and the sixth parabolic pattern 741 may be made of the same dielectric material, the seventh parabolic pattern 750 and the eighth parabolic pattern 751 may be made of the same dielectric material, and the ninth parabolic pattern 760 and the tenth parabolic pattern 761 may be made of the same dielectric material. The first parabolic pattern 720, the third parabolic pattern 730, the fifth parabolic pattern 740, the seventh parabolic pattern 750, the ninth parabolic pattern 760, and the linear pattern 710 may each be made of a different dielectric material.

When unit cells on the planar lens 200 have the same unit area and are made of the same dielectric material, the first parabolic pattern 720 and the second parabolic pattern 721 may be made of a dielectric material having the same height, the third parabolic pattern 730 and the fourth parabolic pattern 731 may be made of a dielectric material having the same height, the fifth parabolic pattern 740 and the sixth parabolic pattern 741 may be made of a dielectric material having the same height, and the ninth parabolic pattern 760 and the tenth parabolic pattern 761 may be made of a dielectric material having the same height.

The first parabolic pattern 720, the second parabolic pattern 721, the third parabolic pattern 730, the fourth parabolic pattern 731, the fifth parabolic pattern 740, the sixth parabolic pattern 741, the seventh parabolic pattern 750, the eighth parabolic pattern 751, the ninth parabolic pattern 760, the tenth parabolic pattern 761, and the linear pattern 710 may be configured with a metal pattern.

In reference numeral 801, unit cells disposed on the planar lens 200 may be disposed in a linear pattern in the x-axis direction having symmetry as a reference of the center of the y-axis.

In reference numeral 802, unit cells disposed on the planar lens 200 may be disposed in a linear pattern in the x-axis direction having symmetry as a reference of the center of the y-axis. A line serving as a reference of symmetry may enable unit cells to have a linear pattern 810. The unit cells may be disposed symmetrically to linear patterns 820, 821, 830, 831, 840, 841, 850, 851, 860, and 861 in the x-axis direction about the linear pattern. The unit cells included in a symmetrical pattern may have the same permittivity.

The first linear pattern 820 and the second linear pattern 821 may be symmetrical about the linear pattern 810. Unit cells in a pattern having a symmetrical relationship may have the same permittivity.

The third linear pattern 830 and the fourth linear pattern 831 may be symmetrical about the linear pattern 810. The fifth linear pattern 840 and the sixth linear pattern 841 may be symmetrical about the linear pattern 810. The seventh linear pattern 850 and the eighth linear pattern 851 may be symmetrical about the linear pattern 810. The ninth linear pattern 860 and the tenth linear pattern 861 may be symmetrical about the linear pattern 810.

When unit cells on the planar lens 200 have the same unit area and height, the first linear pattern 820 and the second linear pattern 821 may be made of the same dielectric material, the third linear pattern 830 and the fourth straight pattern 831 may be made of the same dielectric material, the fifth linear pattern 840 and the sixth linear pattern 841 may be made of the same dielectric material, the seventh linear pattern 850 and the eighth linear pattern 851 may be made of the same dielectric material, and the ninth linear pattern 860 and the tenth linear pattern 861 may be made of the same dielectric material. The first linear pattern 820, the third linear pattern 830, the fifth linear pattern 840, the seventh linear pattern 850, the ninth linear pattern 860, and the linear pattern 810 may each be made of a different dielectric material.

When unit cells on the planar lens 200 have the same unit area and the same material of the dielectric materials, the first linear pattern 820 and the second linear pattern 821 may be made of a dielectric material having the same height, the third linear pattern 830 and the fourth linear pattern 831 may be made of a dielectric material having the same height, the fifth linear pattern 840 and the sixth linear pattern 841 may be made of a dielectric material having the same height, the seventh linear pattern 850 and the eighth linear pattern 851 may be made of a dielectric material having the same height, and the ninth linear pattern 860 and the tenth linear pattern 861 may be made of a dielectric material having the same height. The first linear pattern 820, the third linear pattern 830, a fifth linear pattern 840, the seventh linear pattern 850, the ninth linear pattern 860, and the linear pattern 810 may be made of a dielectric material having different heights.

The first linear pattern 820, the second linear pattern 821, the third linear pattern 830, the fourth linear pattern 831, the fifth linear pattern 840, the sixth linear pattern 841, the seventh linear pattern 850, the eighth linear pattern 851, the ninth linear pattern 860, the tenth linear pattern 861, and the linear pattern 810 may be configured with a metal pattern.

In a disposition pattern of the unit cells on the planar lens 200 of FIGS. 7 and 8, a linear or open curve pattern in which a start point and an end point do not meet is disposed in a line symmetrical shape having one symmetry axis. However, the present invention is not limited thereto, and even if a linear or open curve pattern is not disposed on the planar lens 200, if a start point and an end point do not meet on the planar lens 200, even when unit cells are disposed on the planar lens 200 in a semicircular pattern or an arc pattern, effects of the present invention can be obtained. Further, a single symmetry axis is not required and, for example, two or more symmetry axes such as a hyperbola may be used.

Figure 9:
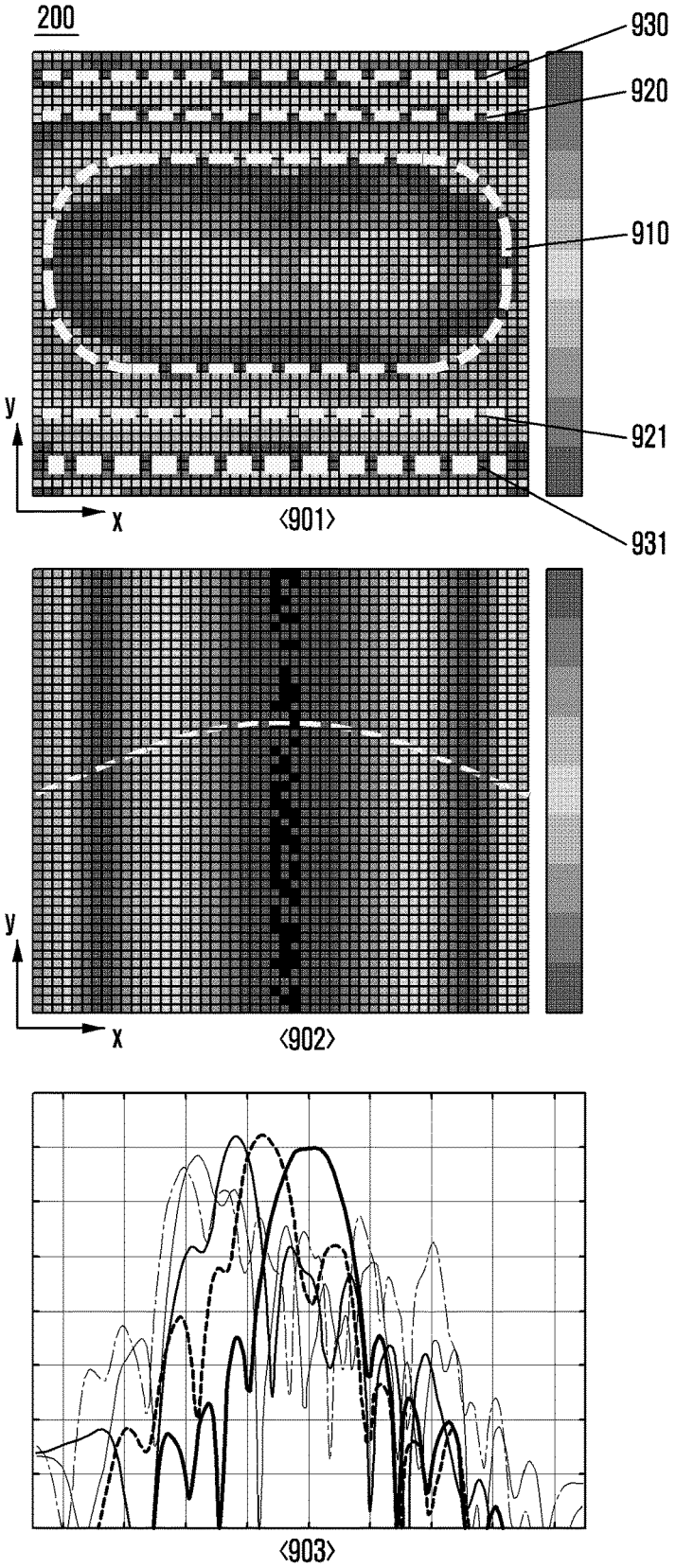
FIG. 9 is a diagram illustrating a unit cell disposition pattern on a planar lens according to various embodiments of the present invention.
Figure 10:
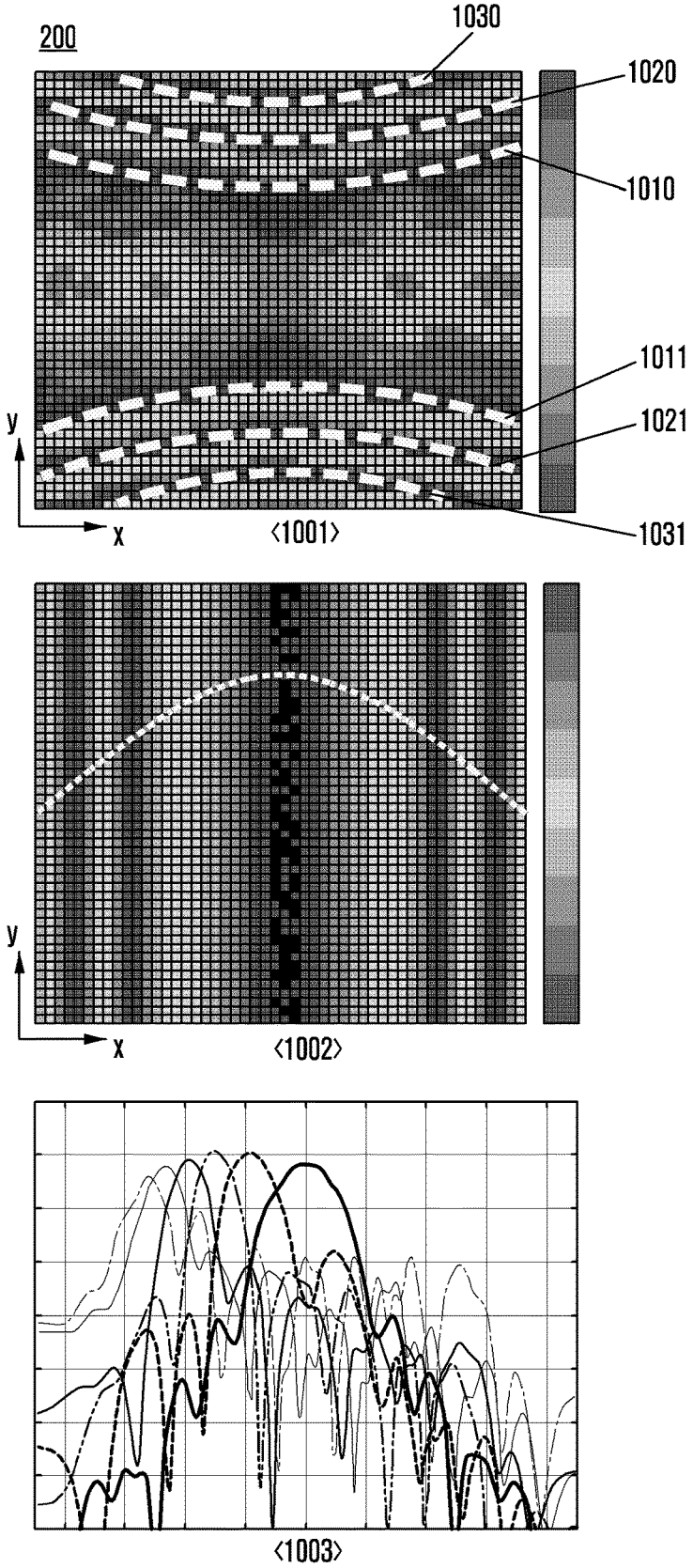
FIG. 10 is a diagram illustrating a unit cell disposition pattern on a planar lens according to various embodiments of the present invention.
Figure 11:
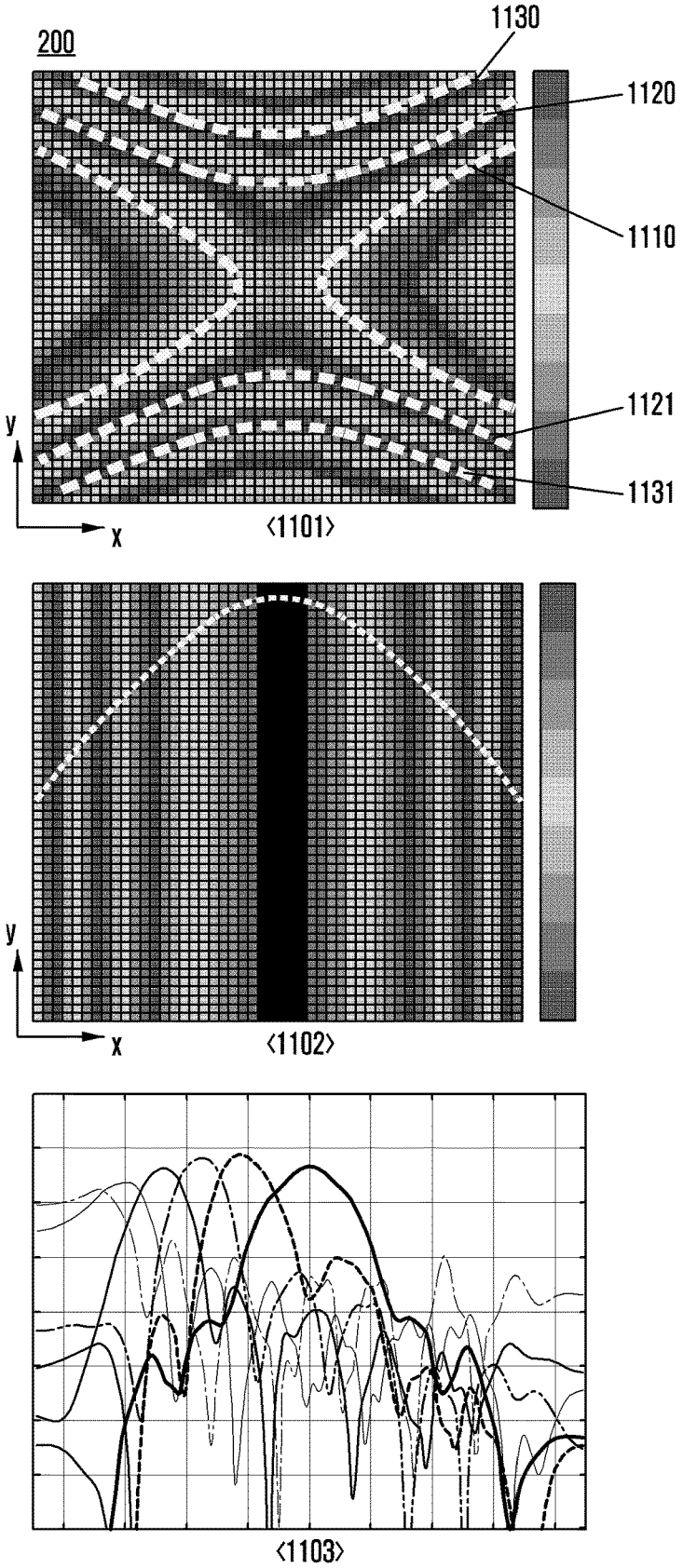
FIG. 11 is a diagram illustrating a unit cell disposition pattern on a planar lens according to various embodiments of the present invention.

FIG. 9 is a diagram illustrating a unit cell disposition pattern on a planar lens 200 according to various embodiments of the present invention. FIG. 10 is a diagram illustrating a unit cell disposition pattern on a planar lens 200 according to various embodiments of the present invention. FIG. 11 is a diagram illustrating a unit cell disposition pattern on a planar lens 200 according to various embodiments of the present invention.

In reference numeral 901, in the planar lens 200, unit cells having the same permittivity may be disposed in a closed curve pattern 910, and the unit cells may be disposed in 1-fold symmetry to have at least one linear pattern 920, 921, 930, and 931. Unit cells in the pattern may have the same permittivity.

Reference numeral 902 represents a phase of radio waves, having passed through the planar lens 200 having the same pattern as that illustrated in reference numeral 901. Each cell having the same shade may have the same phase. It can be seen in the radio waves, having passed through the planar lens 200 having the same pattern as that of the reference numeral 901, that radio waves having the same phase increase because of the closed curve pattern 910 and thus a gain of the radio waves increases. Specifically, reference numeral 903 represents a graph between a phase and a gain, and in the graph, a horizontal axis represents a phase and a vertical axis represents a gain. It can be seen that in a phase of the radio wave, an in-phase is much, and a gain of the radio waves increases.

In FIG. 9, when unit cells disposed on the planar lens 200 have the same unit area and height, materials of dielectric materials of unit cells constituting a pattern may be the same. In unit cells of different patterns, materials of dielectric materials may be different.

In FIG. 9, when unit cells disposed on the planar lens 200 have the same unit area and a material of the dielectric materials is the same, unit cells constituting a pattern may have the same height. Unit cells of other patterns may have different heights.

In FIG. 9, a pattern on the planar lens 200 may be configured with a metal pattern.

In reference numeral 1001, in a planar lens 200, unit cells may be disposed in 1-fold symmetry to have at least one open curved pattern 1010, 1011, 1020, 1021, 1030, and 1031. Unit cells in the pattern may have the same permittivity. Reference numeral 1001 is different from reference numeral 901 in that there is no unit cell disposed in a closed curve pattern.

Reference numeral 1002 represents a phase of radio waves, the radio waves having passed through the planar lens 200 having the same pattern as that of the reference number 1001. Each cell having the same shade may have the same phase. In the radio waves, having passed through the planar lens 200 having the same pattern as that of the reference numeral 1001, radio waves having the same phase have reduced, compared with radio waves in the pattern of the reference numeral 901, and it can be seen that this increases coverage of radio waves more than that in the pattern of the planar lens 200 of the reference numeral 901. Specifically, reference numeral 1003 represents a graph between a phase and a gain, and in the graph, a horizontal axis represents a phase and a vertical axis represents a gain. It can be seen that in a phase of the radio wave, an in-phase is fewer than that of the reference number 903 and coverage of the radio wave is increased. When unit cells on the planar lens 200 have a closed curve pattern, an operation of increasing a gain by matching phases of radio waves may be performed. Further, when the unit cells on the planar lens 200 form an open curved pattern of symmetry, an operation of increasing coverage of radio waves may be performed.

In FIG. 10, when unit cells disposed on the planar lens 200 have the same unit area and height, materials of dielectric materials of unit cells constituting a pattern may be the same. In unit cells having different patterns, materials of dielectric materials may be different.

In FIG. 10, when unit cells disposed on the planar lens 200 have the same unit area and the same material of the dielectric materials, unit cells constituting a pattern may have the same height. Unit cells having different patterns may have different heights.

In FIG. 10, a pattern on the planar lens 200 may be configured with a metal pattern.

In reference numeral 1101, in the planar lens 200, unit cells may be disposed in 2-fold symmetry to have at least one open curved pattern 1110, 1120, 1121, 1130, and 1131. Unit cells in the pattern may have the same permittivity.

Reference numeral 1102 represents a phase of radio waves, the radio waves having passed through the planar lens 200 having the same pattern as that of the reference number 1101. Each cell having the same shade may have the same phase. In the radio waves, having passed through the planar lens 200 having the same pattern as that of the reference numeral 1101, radio waves having the same phase are reduced, compared with the reference numeral 1001; and it can be seen that this increases coverage of radio waves, compared with a pattern of the planar lens 200 of the reference numeral 1001. Specifically, reference numeral 1103 represents a graph between a phase and a gain; and, in the graph, a horizontal axis represents a phase and a vertical axis represents a gain. It can be seen that in a phase of radio waves, an in-phase is fewer than that of the reference number 1003 and coverage of the radio wave is increased. The open curve pattern may perform an operation of increasing coverage of radio waves as a symmetry axis increases.

In FIG. 11, when unit cells disposed on the planar lens 200 have the same unit area and height, materials of dielectric materials of unit cells constituting a pattern may be the same. In unit cells having different patterns, materials of dielectric materials may be different.

In FIG. 11, when the unit cells disposed on the planar lens 200 have the same unit area and the same material of the dielectric materials, unit cells constituting a pattern may have the same height. Unit cells having different patterns may have different heights.

In FIG. 11, a pattern on the planar lens 200 may be configured with a metal pattern.

Figure 12:
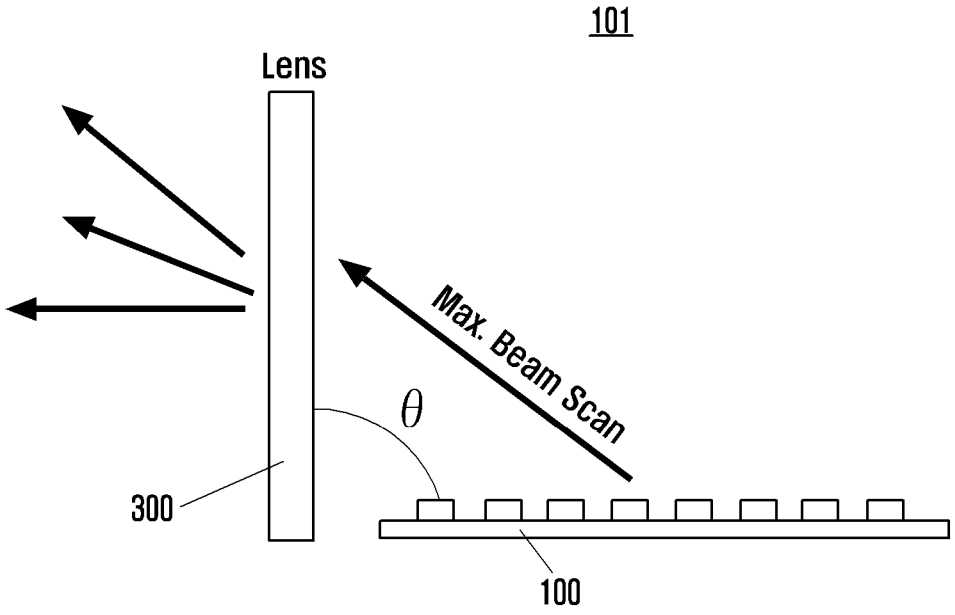
FIG. 12 is a diagram illustrating a method of disposing a planar lens according to various embodiments of the present invention.
Figure 13:
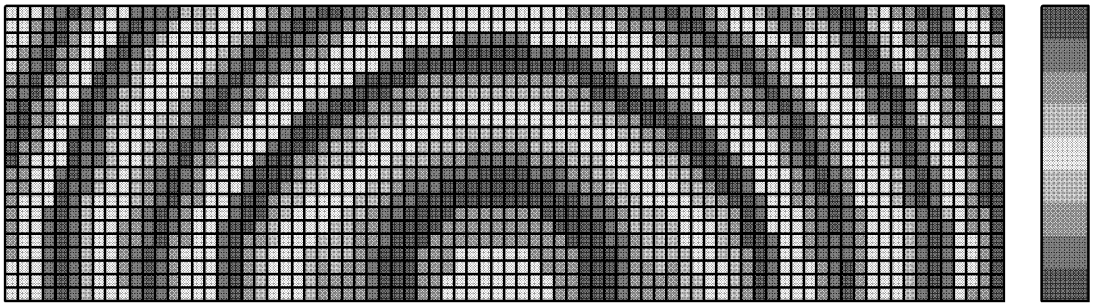
FIG. 13 is a diagram illustrating a phase of radio waves before and after passing through a planar lens 300 of FIG. 12.
Figure 13:
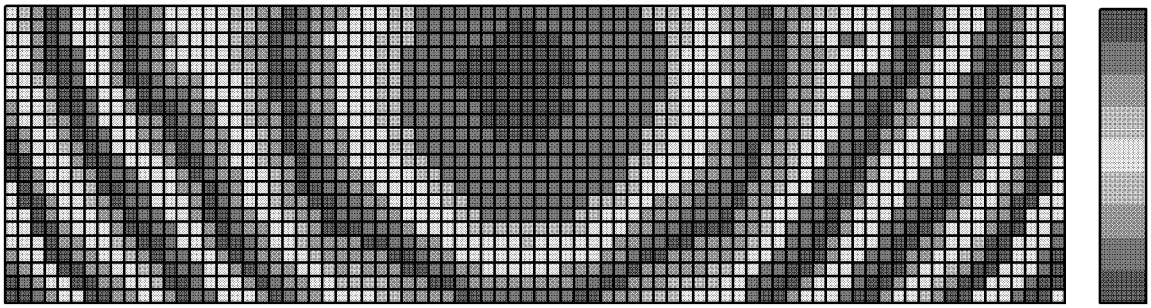
Figure 13:
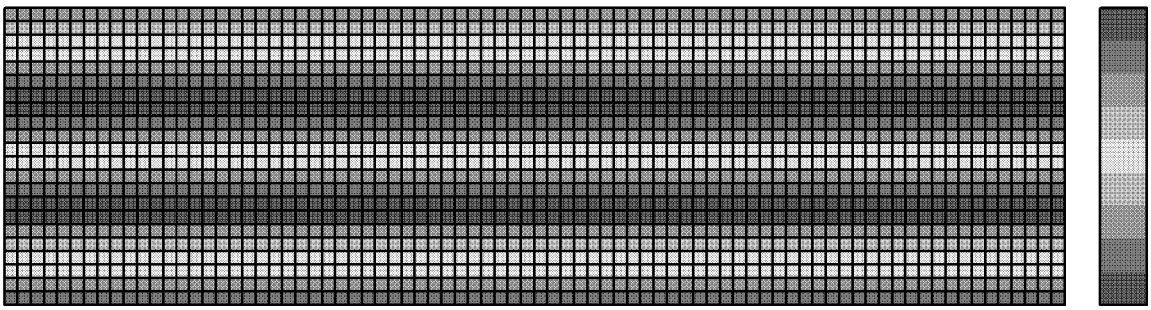

FIG. 12 is a diagram illustrating a method of disposing a planar lens 300 according to various embodiments of the present invention. FIG. 13 is a diagram illustrating a phase of radio waves before and after passing through the planar lens 300 of FIG. 12.

FIGS. 2 to 11 illustrate a method of disposing the antenna array 100 and the planar lens 200 in parallel, but FIG. 12 illustrates a case in which the antenna array 100 and the planar lens 300 are disposed at a predetermined angle. As a steering angle θ between the antenna array 100 and the planar lens 300 approaches 90°, coverage of radio waves passing through the planar lens 300 may increase. Reference numeral 1301 represents a phase of radio waves before the radio waves pass through the planar lens 300 and represents variously distributed phases. Reference numeral 1302 represents a unit cell disposition pattern of the planar lens 300 for correcting a phase of radio waves. A unit cell disposition pattern of the planar lens 300 may be a closed curve pattern or a pattern of FIGS. 2 to 11. Reference numeral 1303 represents a phase of radio waves, the radio waves having passed through the planar lens 300, and it can be seen that the propagation phase includes various phases and that coverage of the radio wave is increased.

Figure 14:
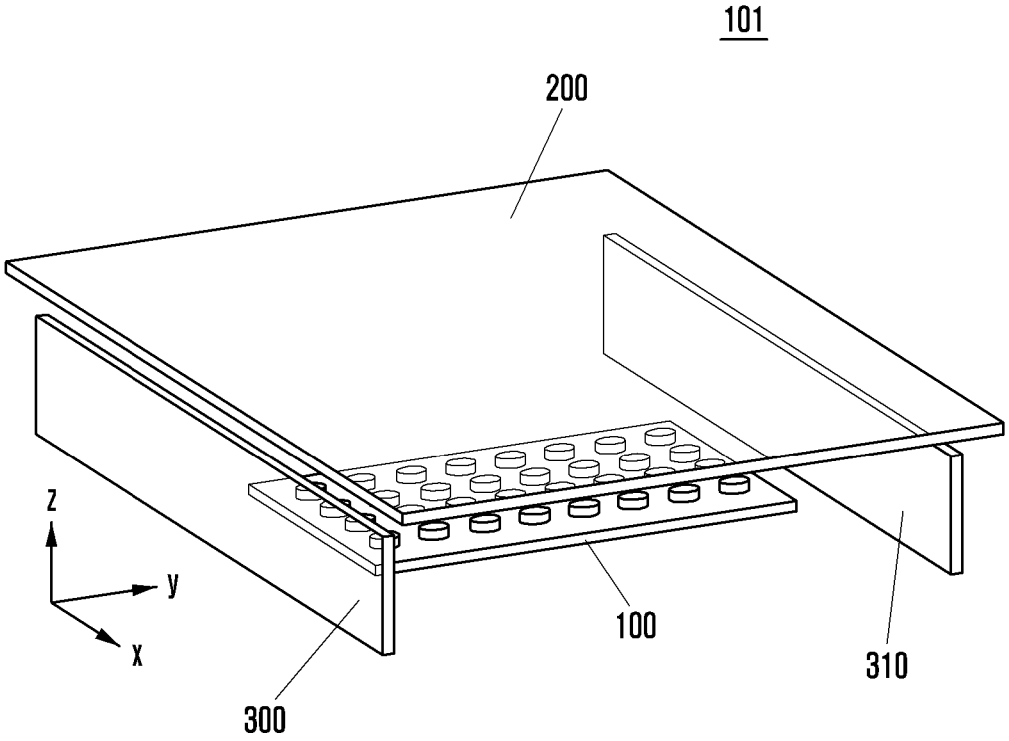
FIG. 14 is a diagram illustrating a method of disposing a plurality of planar lenses of a phase compensation lens antenna device according to various embodiments of the present invention.

FIG. 14 is a diagram illustrating a method of disposing a plurality of planar lenses of a phase compensation lens antenna device 101 according to various embodiments of the present invention.

The phase compensation lens antenna device 101 may include a parallel planar lens 200 disposed parallel to the antenna array 100, a first side planar lens 300 disposed at a first side surface of a space between the antenna array 100 and the parallel planar lens 200, and a second side planar lens 310 disposed at a second side surface of a space between the antenna array 100 and the parallel planar lens 200.

The parallel planar lens 200 and the first side planar lens 300 may be disposed at a predetermined angle (e.g., 90°). The parallel planar lens 200 and the second side planar lens 310 may be disposed at a predetermined angle (e.g., 90°). The parallel planar lens 200, the first side planar lens 300, and the second side planar lens 310 may be disposed in a shape of a rectangular table having three sides. For example, in the table, legs may be the first side planar lens 300 and the second side planar lens 310, and a support may be the parallel planar lens 200.

According to various embodiments, the planar lens 300 may be disposed in a rectangular parallelepiped shape, except for a plane in which the antenna array 100 is disposed in a rectangular parallelepiped.

FIGS. 15 to 18 are diagrams illustrating a method of disposing a plurality of planar lenses of a phase compensation lens antenna device 101 using a case 400.

Figure 15:
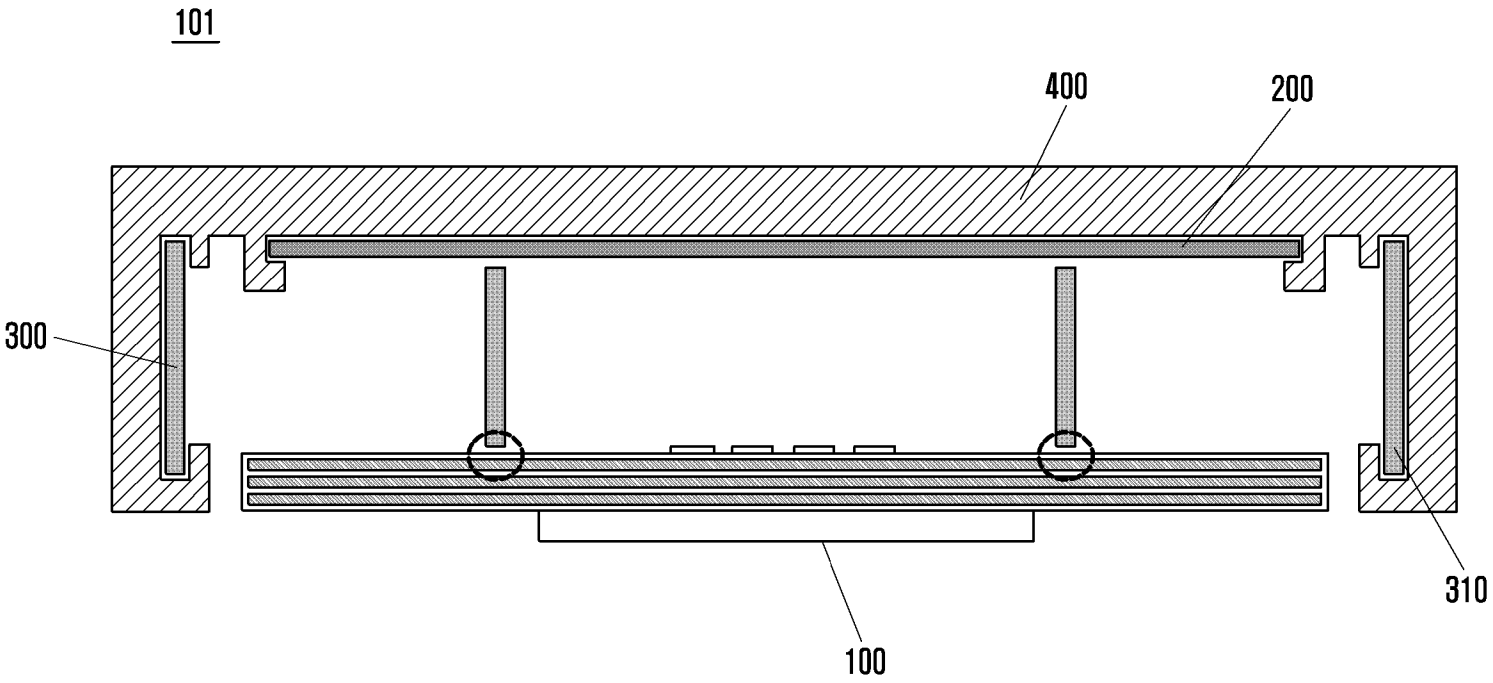
FIGS. 15 to 18 are diagrams illustrating a method of disposing a plurality of planar lenses of a phase compensation lens antenna device using a case.

In FIG. 15, the case 400 may have a shape of a rectangular table configured with three surfaces and be made of a material that transmits radio waves. At a surface (e.g., parallel surface) facing the antenna array 100 inside the case 400, a parallel planar lens 200 may be disposed. At a first surface perpendicular to the antenna array 100 inside the case 400, a first side planar lens 300 may be disposed. At a second surface perpendicular to the antenna array 100 inside the case 400, a second side planar lens 310 may be disposed.

Figure 16:
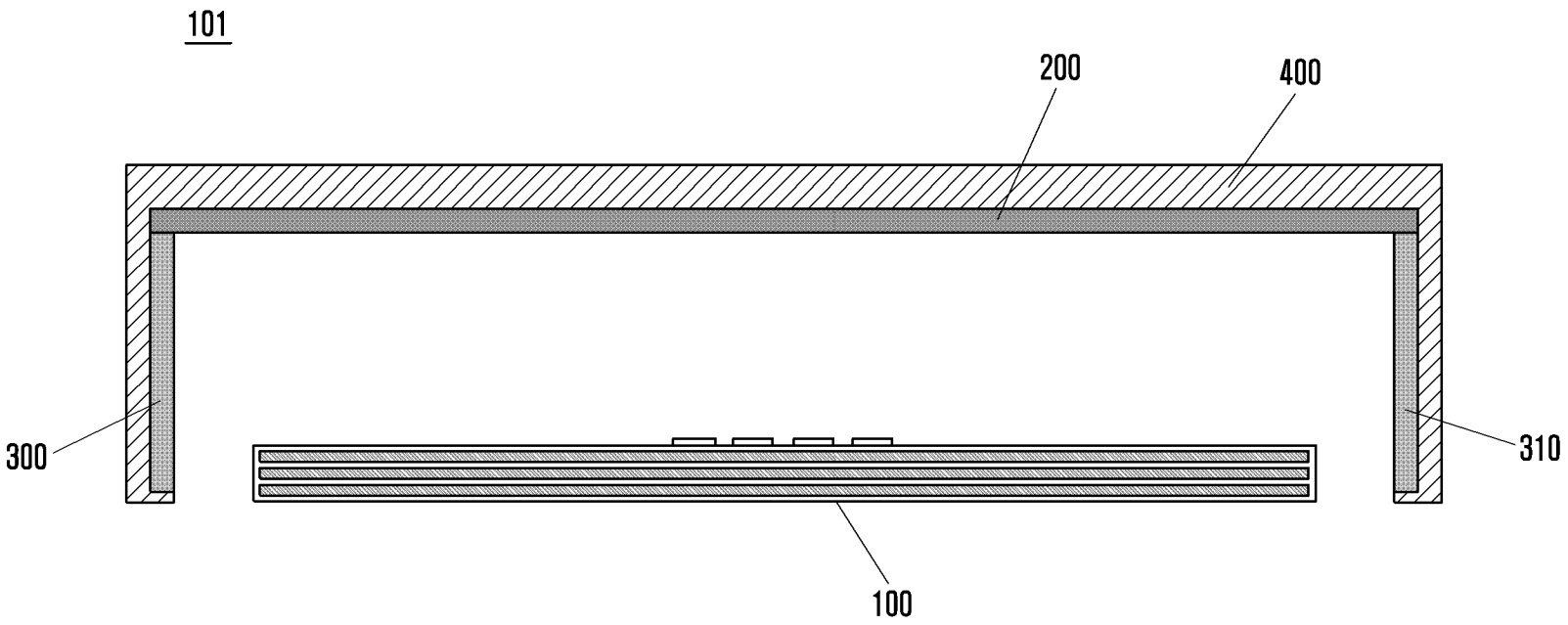

In FIG. 16, the case 400 may have a shape of a rectangular table configured with three surfaces and be made of a material that transmits radio waves. At a surface (e.g., parallel surface) facing the antenna array 100 inside the case 400, the parallel planar lens 200 may be printed in the case 400. At a first surface perpendicular to the antenna array 100 inside the case 400, a first side planar lens 300 may be printed. At a second surface perpendicular to the antenna array 100 inside the case 400, a second flat side lens 310 may be printed.

Figure 17:
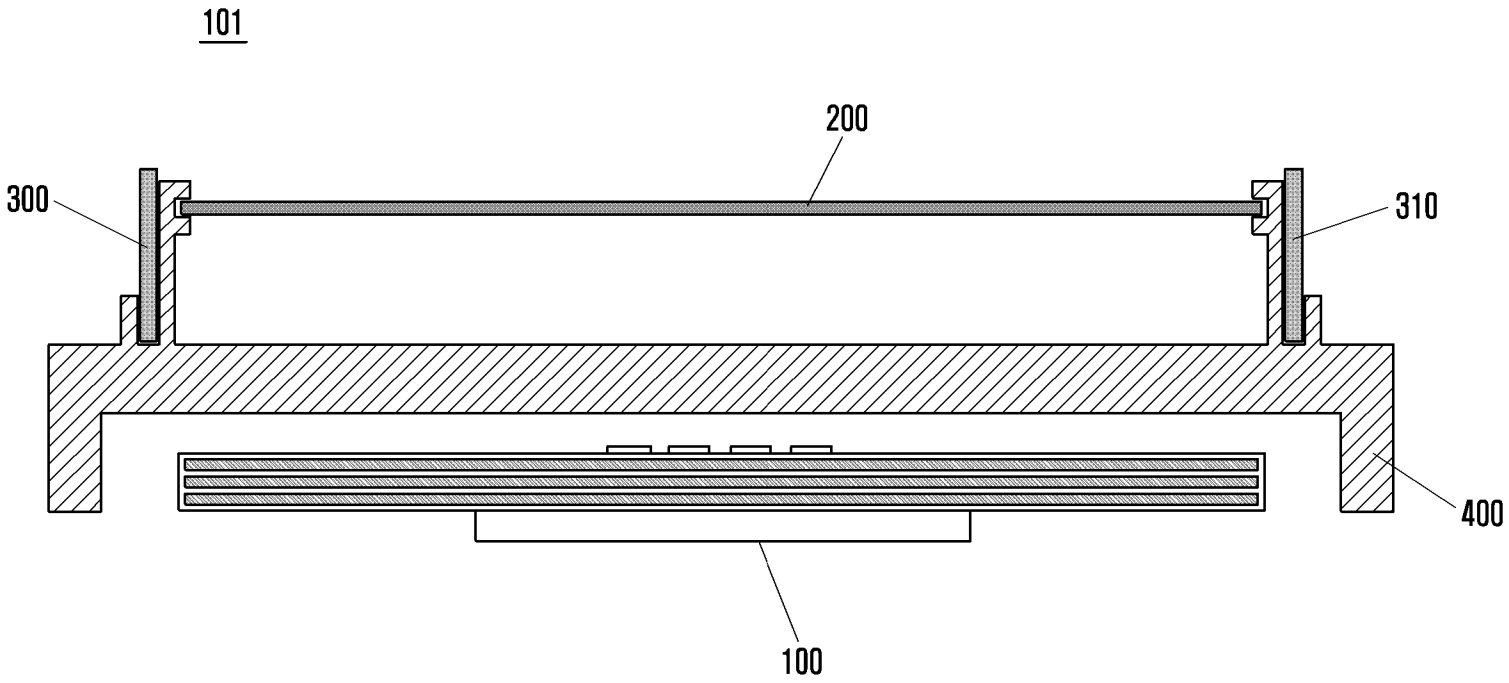

In FIG. 17, the case 400 may have a shape of a rectangular table configured with three surfaces and be made of a material that transmits radio waves.

At a surface (e.g., parallel plane) facing the antenna array 100 outside the case 400, a parallel planar lens 200 may be disposed. At a first surface perpendicular to the parallel planar lens 200 outside the case 400, a first side planar lens 300 may be disposed. At a second surface perpendicular to the parallel planar lens 200 outside the case 400, a second side planar lens 310 may be disposed.

Figure 18:
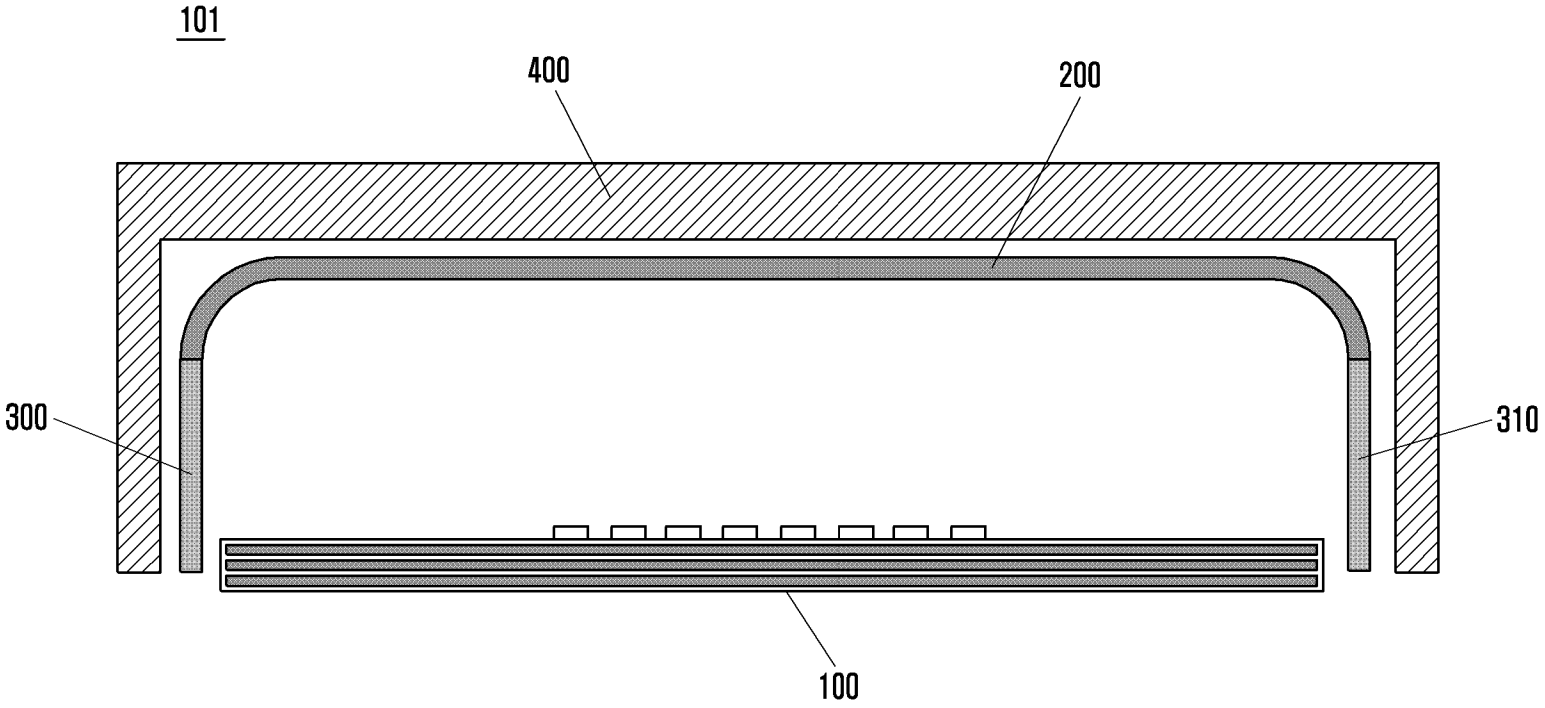

In FIG. 18, the case 400 may have a shape of a rectangular table configured with three surfaces and be made of a material that transmits radio waves. At a surface (e.g., parallel surface) facing the antenna array 100 inside the case 400, a plane parallel lens 200 may be disposed. At the first surface perpendicular to the antenna array 100 inside the case 400, a first side planar lens 300 may be disposed. At the second surface perpendicular to the antenna array 100 inside the case 400, a second side planar lens 310 may be disposed. In this case, the parallel planar lens 200, the first side planar lens 300, and the second side planar lens 310 may be formed integrally with a Flexible PCB (FPCB).

Figure 19:
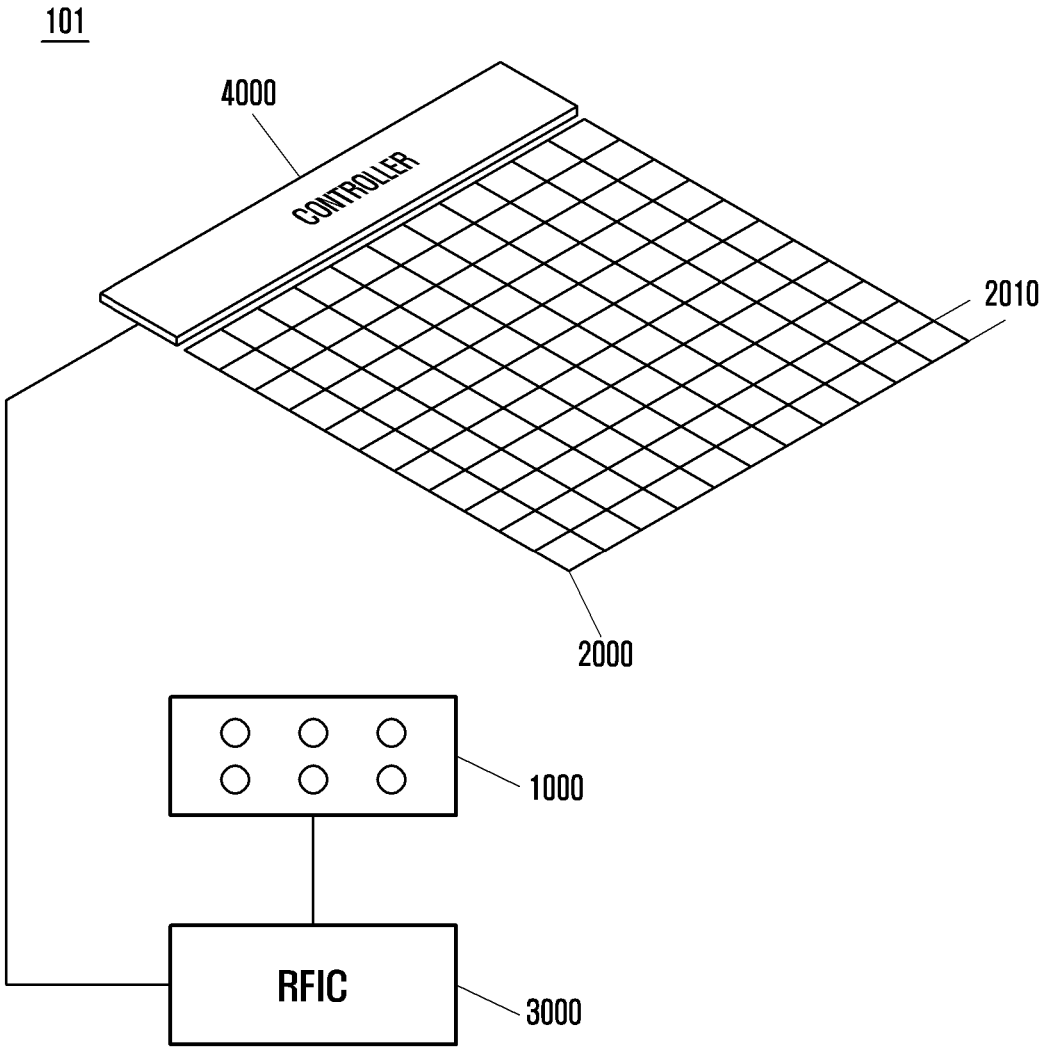
FIG. 19 is a diagram illustrating a phase compensation lens antenna device including an adaptive planar lens according to various embodiments of the present invention.

FIG. 19 is a diagram illustrating a phase compensation lens antenna device 101 including an adaptive planar lens 2000 according to various embodiments of the present invention.

The phase compensation lens antenna device 101 may include an antenna array 1000, an active planar lens 2000, a radio frequency integrated circuit (RFIC) 3000, and a controller 4000.

The RFIC 3000 may have a propagation phase of radio waves to be radiated by the antenna array 1000 and coordinate information of the antenna, and the antenna array 1000 may radiate radio waves under the control of the RFIC 3000. The RFIC 3000 may transmit the propagation phase and the coordinate information of the antenna to the controller 4000. The controller 4000 may decode the coordinate information of the antenna to change permittivity of a unit cell 2010 according to the propagation phase. The unit cell 2010 may be configured with an active device so that permittivity may vary according to an electrical signal.

The term "module" used in this document includes a unit configured with hardware, software, or firmware and may be interchangeably used with a term such as a logic, logic block, component, or circuit. The "module" may be an integrally configured component or a minimum unit that performs at least one function or a portion thereof. The "module" may be implemented mechanically or electronically and may include, for example, an application-specific integrated circuit (ASIC) chip, field-programmable gate arrays (FPGAs), and a programmable logic device, which are known or to be developed in the future, that perform any operation. At least a portion of a device (e.g., modules or functions thereof) or a method (e.g., operations) according to various exemplary embodiments may be implemented with an instruction stored at a computer readable storage medium (e.g., the memory) in a form of a program module. When the instruction is executed by a processor (e.g., the processor), the processor may perform a function corresponding to the instruction. A computer readable recording medium may include a hard disk, floppy disk, magnetic medium (e.g., magnetic tape), optical recording medium (e.g., disc read-only memory (CD-ROM), digital versatile disc (DVD), magnetic-optical medium (e.g., floptical disk), and internal memory. The instruction may include a code made by a compiler or a code that may be executed by an interpreter. A module or a programming module according to various embodiments may include at least one of the foregoing elements, may omit some elements, or may further include another element. According to various exemplary embodiments, operations performed by a module, a program module, or another constituent element may be sequentially, parallelly, repeatedly, or heuristically executed, at least some operations may be executed in a different order or omitted, or another operation may be added.

The invention claimed is:

1. A phase compensation lens antenna, comprising:

an antenna array comprising a plurality of antennas; and a planar lens disposed parallel to the antenna array, wherein unit cells of the planar lens are disposed in at least one of a closed curve pattern, a linear pattern, or an open curve pattern based on a varied pattern of cell permittivity, and wherein the unit cells are configured to correct a phase of radio waves radiated from the antenna array according to the permittivity.

2. The phase compensation lens antenna of claim 1, wherein the planar lens comprises at least one of the linear pattern or the open curve pattern and is disposed in line symmetry.

3. The phase compensation lens antenna of claim 2, wherein the planar lens further comprises at least one closed curve pattern, and wherein unit cells disposed in the closed curve pattern have the same permittivity.

4. The phase compensation lens antenna of claim 2, wherein the planar lens constitutes the open curve pattern comprising at least one symmetry axis.

5. The phase compensation lens antenna of claim 2, wherein a phase is corrected when radio waves pass through a first axis of the planar lens, and wherein a phase is not corrected when radio waves pass through a second axis perpendicular to the first axis.

6. The phase compensation lens antenna of claim 1, further comprising:

a first vertical planar lens disposed vertically to a first side of a separation space of the antenna array and the planar lens disposed in parallel; and a second vertical planar lens disposed in a plane parallel to the first side.

7. The phase compensation lens antenna of claim 6, wherein the first vertical planar lens comprises at least one of the linear pattern or the open curve pattern and is disposed in line symmetry.

8. The phase compensation lens antenna of claim 6, wherein the first vertical planar lens comprises at least one closed curve pattern, and wherein unit cells disposed in the closed curve pattern have the same permittivity.

9. The phase compensation lens antenna of claim 6, wherein the second vertical planar lens comprises at least one of the linear pattern or the open curve pattern and is disposed in line symmetry.

10. The phase compensation lens antenna of claim 6, wherein the second vertical planar lens comprises at least one closed curve pattern, and wherein unit cells disposed in the closed curve pattern have the same permittivity.

11. The phase compensation lens antenna of claim 6, further comprising a three-sided table-shaped case, wherein the planar lens, the first vertical planar lens, and the second vertical planar lens are disposed inside the case.

12. The phase compensation lens antenna of claim 6, further comprising a three-sided table-shaped case, wherein the planar lens, the first vertical planar lens, and the second vertical planar lens are disposed outside the case.

13. The phase compensation lens antenna of claim 6, further comprising a three-sided table-shaped case, wherein the planar lens, the first vertical planar lens, and the second vertical planar lens are disposed inside the case and are integrally formed with a flexible printed circuit board (FPCB).

14. The phase compensation lens antenna of claim 6, further comprising a three-sided table-shaped case, wherein the planar lens, the first vertical planar lens, and the second vertical planar lens are disposed inside the case and are printed inside the case.

15. The phase compensation lens antenna of claim 1, wherein the unit cell constituting the linear pattern or the open curve pattern is made of a dielectric material of the same material when the unit cells constituting the planar lens have the same height and the same unit area, and wherein the unit cell constituting the linear pattern or the open curve pattern is made of a dielectric material of the same height when the unit cells constituting the planar lens are made of a dielectric material of the same material and have the same unit area.

* * * * *